United States Patent [19]

Beck et al.

[11] Patent Number: 4,592,812

[45] Date of Patent: Jun. 3, 1986

[54] METHOD AND APPARATUS FOR ELECTROLYTIC REDUCTION OF ALUMINA

[75] Inventors: Theodore R. Beck; Richard J. Brooks, both of Seattle, Wash.

[73] Assignees: Electrochemical Technology Corp.; Brooks Rand, Ltd., both of Seattle, Wash.

[21] Appl. No.: 664,497

[22] Filed: Oct. 25, 1984

[51] Int. Cl.[4] ..... C25C 3/06; C25C 3/08

[52] U.S. Cl. ..... 204/67; 204/243 R; 204/245; 204/247; 204/274; 204/294

[58] Field of Search ..... 204/67, 243 R, 290 R, 204/299 F, 247, 245, 294

[56] References Cited

U.S. PATENT DOCUMENTS

| | | | |
|---|---|---|---|
| 4,222,830 | 9/1980 | Dawless et al. | 204/67 |
| 4,308,115 | 12/1981 | Foster et al. | 204/290 R |
| 4,338,177 | 7/1982 | Withers et al. | 204/67 |

*Primary Examiner*—Howard S. Williams

*Attorney, Agent, or Firm*—Marshall, O'Toole, Gerstein, Murray & Bicknell

[57] ABSTRACT

A cell for the electrolytic reduction of alumina to aluminum comprises an electrolyte bath composed of halide salts having a density greater than aluminum but less than alumina. A non-consumable anode is located at the bottom of the bath, and a dimensionally stable cathode coated with titanium diboride is spaced above the anode and totally immersed in the bath. Particles of alumina are introduced into the bath where the alumina dissolves and forms ions of aluminum and oxygen. The oxygen ions are converted at the anode to gaseous oxygen which bubbles upwardly through the bath, agitating the bath. As a result, the bath is substantially saturated with dissolved alumina in the region of the anode, and the build-up of a layer of undissolved alumina on the anode is prevented. The aluminum ions are converted to metallic aluminum at the cathodes, and molten aluminum accumulates as a pool atop the bath above the cathodes. In one embodiment, the upwardly rising gaseous oxygen bubbles are prevented from mixing with the pool of molten aluminum.

29 Claims, 8 Drawing Figures

FIG. 6
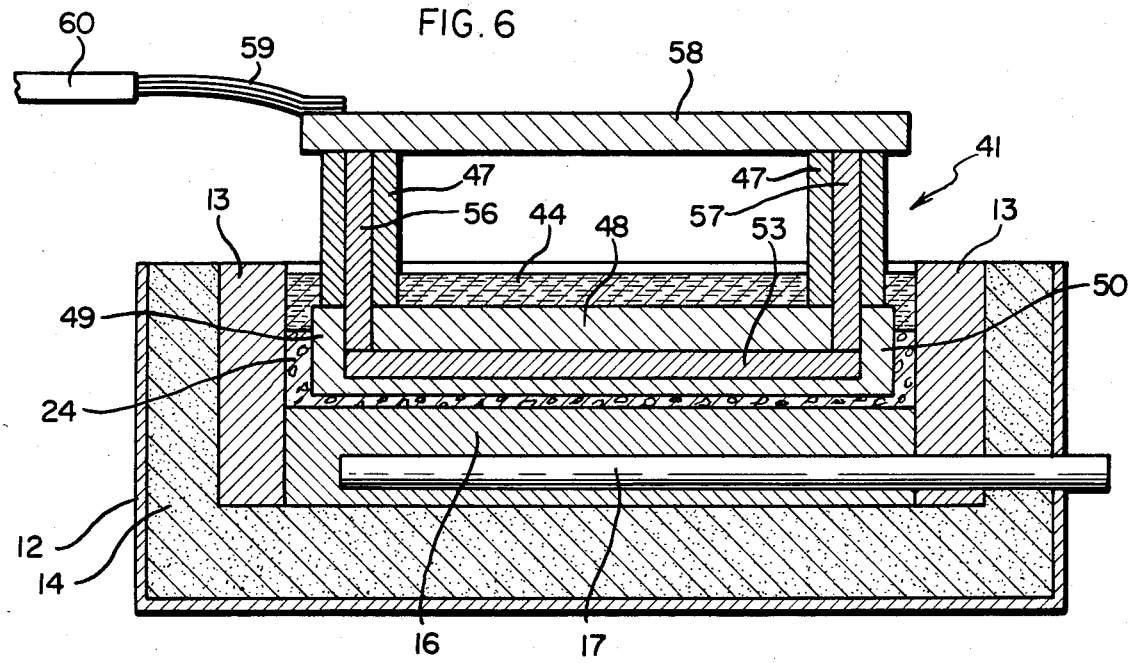
FIG. 7
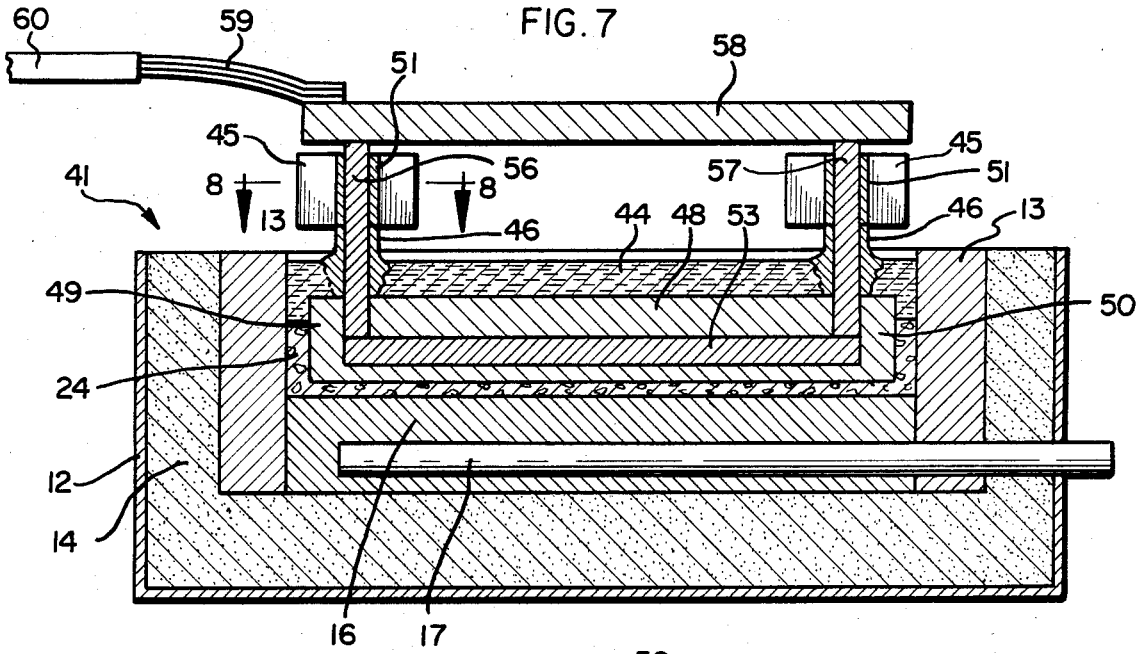
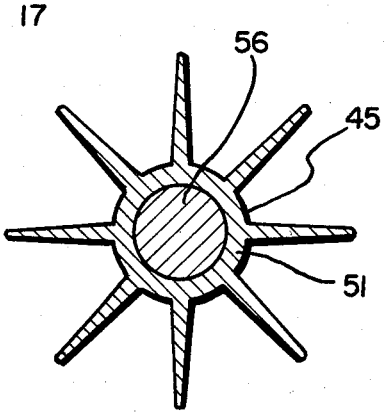
FIG. 8

METHOD AND APPARATUS FOR ELECTROLYTIC REDUCTION OF ALUMINA

BACKGROUND OF THE INVENTION

The present invention relates generally to the production of metallic aluminum from alumina ($Al_2O_3$) and more particularly to a method and apparatus for electrolytically reducing alumina to aluminum.

For many decades, the principal commercial method employed for the electrolytic reduction of alumina to aluminum has been the Hall-Heroult Process. In this process, a molten electrolyte comprising sodium cryolite ($Na_3AlF_6$) as the principal constituent is contained in a cell or pot, the interior of which is lined with carbon. A pool of molten aluminum rests on the bottom of the cell and forms the cathode for the cell, and consumable carbon anodes located above the electrolyte bath extend downwardly through the top of the bath. Alumina is introduced into the molten electrolyte bath wherein the alumina dissolves and a number of reactions occur, eventually producing molten aluminum which accumulates at the bottom of the cell and carbon dioxide and some carbon monoxide, from a side reaction, which are given off from the top of the cell.

A substantial amount of electric power is consumed in the process. In addition, there is a continual consumption of carbon anodes which requires continual adjustment of the carbon anode downwardly toward the cathode at the bottom of the cell to maintain a desired anode cathode distance (ACD) between the two electrodes. The larger the ACD, the greater the resistance between the electrodes and the more power consumed. On the other hand, the ACD cannot be too small because of the danger of short-circuiting between the molten aluminum cathode and the anodes due to agitation by electromagnetic forces in the molten metal. Also, there can be an increase in power consumption due to an increase in bath resistance caused by an increase in the concentration of carbon dioxide gas bubbles in the space between the anode and a cathode when the distance between the two electrodes is decreased. Typically, the ACD averages about 1.5–2.0 inches (38–51 mm) in the Hall-Heroult process.

Because the carbon anodes are consumed during the process, they must be replaced regularly, and this requires an anode manufacturing plant and continual handling of new anodes and old anode "butts" in the plant. Moreover, hot anodes in the cells are also subject to wasteful "air burn".

The life of the cell is limited by swelling of the carbon lining which is believed to be due in large part to the formation of a lamellar sodium compound in the carbon. The sodium comes from a side reaction on the carbon surface in contact with the sodium cryolite.

If alumina is introduced into the bath at too fast a rate, the alumina will be incompletely dissolved in the bath, and some of it will sink through the molten aluminum below the bath and form a "muck" on the carbon lining at the bottom of the cell. Once the alumina sinks under the molten aluminum, it is shielded from dissolution in the electrolyte bath and further accumulates on the bottom of the cell. Muck creates a high resistance between the metal pool and the carbon bottom lining to which the current flows. This results in high temperatures which produce inefficient or "sick" pots. A typical normal operating temperature in the Hall-Heroult Process is 950°–1,000° C. (1,742°–1,832° F.).

The sick pot problem is controlled by deliberately starving the pots so that they go on "anode effect" about once a day. Anode effect is a high voltage condition at the anode which generates carbon monoxide and carbon tetrafluoride ($CF_4$). The anode effect is indicated by an incandescent light connected across the cell. The light goes on when the voltage across the cell increases from a normal 4.5 to 5 volts to as much as 60 volts. The anode effect is eliminated by stirring alumina into the bath. The costs of anode effect are energy inefficiency, an increase in pot temperature and an increase in carbon anode consumption.

Numerous attempts have been made to increase the energy efficiency of the alumina reduction process and to solve various operating problems. These attempts have included the development of non-consumable, dimensionally stable anodes. A process using a non-consumable anode produces oxygen rather than carbon dioxide, but this requires an additional thermodynamic potential of one volt which is a disadvantage. The principal advantages are elimination of the anode manufacturing plant with its mixing and pressing equipment and baking furnaces, the elimination of the purchase of carbon anode materials and the elimination of anode and butt handling in the reduction plant.

Non-consumable anodes are made of electrically conductive oxides or of cermets (mixtures of oxides and metallic particles). Examples of non-consumable anode materials are tin oxide ($SnO_2$) and oxides of iron and nickel bonded with metallic iron and nickel. However, with the latter type of anode, the concentration of the alumina in the bath must be kept greater than about 40% of the alumina content at which the bath is saturated with alumina to prevent dissolution of the anode at a standard operating temperature of about 975° C. (1,787° F.).

Developmental work has also been conducted on cathodes covered with titanium diboride ($TiB_2$). Titanium diboride is an electrical conductor, it is wet by aluminum, and it is resistant to attack by molten aluminum and by the cryolite electrolyte. A cathode covered with titanium diboride has a carbon interior and is dimensionally stable.

Withers et al. U.S. Pat. No. 4,338,177, in FIG. 12, discloses a process for the electrolytic reduction of alumina employing a heavy electrolyte bath having a density greater than that of molten aluminum which accumulates as a pool on the top of the bath. A titanium diboride cathode extends downwardly through the top of the bath and terminates a relatively short distance from the bottom of the cell at which is located an anode comprising lumps or pieces composed of alumina and a carbonaceous material. The anode pieces reside at the bottom of the cell as a result of having a density greater than that of the heavy electrolyte bath or else are retained at the bottom of the bath by a grate. Carbon dioxide is liberated during the process, and this is undesirable. In addition to increasing the resistance of the bath, the carbon dioxide reportedly caused a back reaction with the aluminum floating on the top of the bath, thereby decreasing the efficiency of the process. A trough was used at the top of the bath to keep the aluminum pool out of the path of the carbon dioxide liberated during the process.

To form the anode, it was necessary to subject the mixture of alumina and carbonaceous material to high pressure molding to form anode pieces of sufficient density to sink to the bottom of the bath. Absent this high density, it was necessary to employ a graphite grate to hold the anode pieces on the bottom of the cell.

A process employed in the electro-refining of metallic aluminum utilizes an electrolytic cell having an electrolyte bath heavier than molten aluminum which thus accumulates at the top of the cell. In this process, graphite current collectors extend downwardly into the refined pool of aluminum on the top of the electrolyte bath, and the refined aluminum serves as the cathode for the cell. The anode is located at the bottom of the cell and is composed of an aluminum-copper alloy which is denser than the electrolyte. The bottom of the cell is lined with carbon, and steel conductor bars extend into the carbon lining at the bottom of the cell for the purpose of conducting current thereto.

SUMMARY OF THE INVENTION

The disadvantages and drawbacks of the prior art methods and apparatus for the electrolytic reduction of alumina have been eliminated by an apparatus and method in accordance with the present invention.

The cell of the present invention comprises a molten electrolyte bath composed of halide salts having a density greater than that of molten aluminum (2.3 g/cm$^3$), and less than that of alumina (4.0 g/cm$^3$). Because, for reasons to be subsequently explained, the cell is operable at a lower temperature than the Hall-Heroult Process, the bath has a melting point lower than that of sodium cryolite. Bath mixtures of sodium, barium, lithium and aluminum fluorides and chlorides having the desired lower melting point are well known.

A non-consumable anode is located at the bottom of the bath, and a plurality of dimensionally stable cathodes are located above the anode but entirely below the top surface of the bath. Each cathode has a cathode bottom spaced above the anode a short distance and cathode sides extending upwardly from the cathode bottom. The surfaces of the cathode sides and bottom are covered with titanium diboride, and the interior of the cathode is composed of carbon (e.g., graphite).

Alumina particles devoid of carbonaceous material are introduced into the cell, and an electric current is passed through the bath from the anode to the cathodes. Ions of aluminum and oxygen ($Al^{3+}$ and $O^{--}$) are formed from the alumina in the bath. (Actually, these ions are complexed with each other and with fluoride ions ($F^-$), but the simple case discussed in the preceding sentence suffices for the present discussion.) The oxygen ions are converted into gaseous oxygen at the anode, and the aluminum ions are converted into metallic aluminum at the cathodes.

The gaseous oxygen formed at the anode bubbles upwardly therefrom, through the bath, agitates the bath and fluidizes the alumina particles in the bath. This enhances the dissolution of alumina in that part of the bath adjacent the anode to obtain and maintain there near-saturation with dissolved alumina. In addition, the generation of oxygen bubbles at the anode inhibits substantially the settling of alumina particles in substantial amounts on the anode at the bottom of the bath. Substantial settling out of alumina particles would be undesirable because it would increase the resistance between the two electrodes.

The present invention thus enables one to maintain a condition of near-saturation of alumina adjacent the anode while also maintaining undissolved alumina particles in suspension adjacent the anode where these particles are needed to provide a ready supply of undissolved alumina for further dissolution there. Maintaining the bath in a saturated condition near the anode is desirable because it allows one to lower the bath temperature which increases current efficiency and decreases corrosion of the electrodes and of the cell's lining.

The metallic aluminum formed at the cathodes flows along the cathode surfaces covered by titanium diboride to a location atop the bath where the molten aluminum accumulates.

In a preferable embodiment, the oxygen bubbling upward through the bath is prevented from mixing with the molten aluminum accumulating atop the bath. This is accomplished by physically dividing the top of the electrolyte bath into a first zone located directly above a cathode and a second zone located between adjacent cathodes. Barrier walls composed of refractory material are utilized for this purpose. These walls block the oxygen from entering the first zone and confine the oxygen to the second zone. The metallic aluminum forming on the bottom of a cathode and flowing upwardly along the cathode sides is directed into the first zone, from which the oxygen is excluded.

The cathodes may be immovably mounted in the cell, in which case the side walls and bottom of the cell are provided with cooling structure, or the cathodes may be mounted for vertical movement relative to the anode to vary the distance therebetween thereby varying the resistance between electrodes and controlling the temperature generated by the process.

The molten aluminum accumulating on the top of the cell may be removed from the cell in a conventional manner, such as by siphoning.

Other features and advantages are inherent in the method and apparatus claimed and disclosed or will become apparent to those skilled in the art from the following detailed description in conjunction with the accompanying diagrammatic drawings.

BRIEF DESCRIPTION OF THE DRAWINGS

FIG. 6 is a sectional view of another embodiment of the present invention;

FIG. 7 is a sectional view of a variation of the embodiment of FIG. 6; and FIG. 8 is a fragmentary sectional view taken along line 8—8 in FIG. 7.

DETAILED DESCRIPTION

Figure 1:
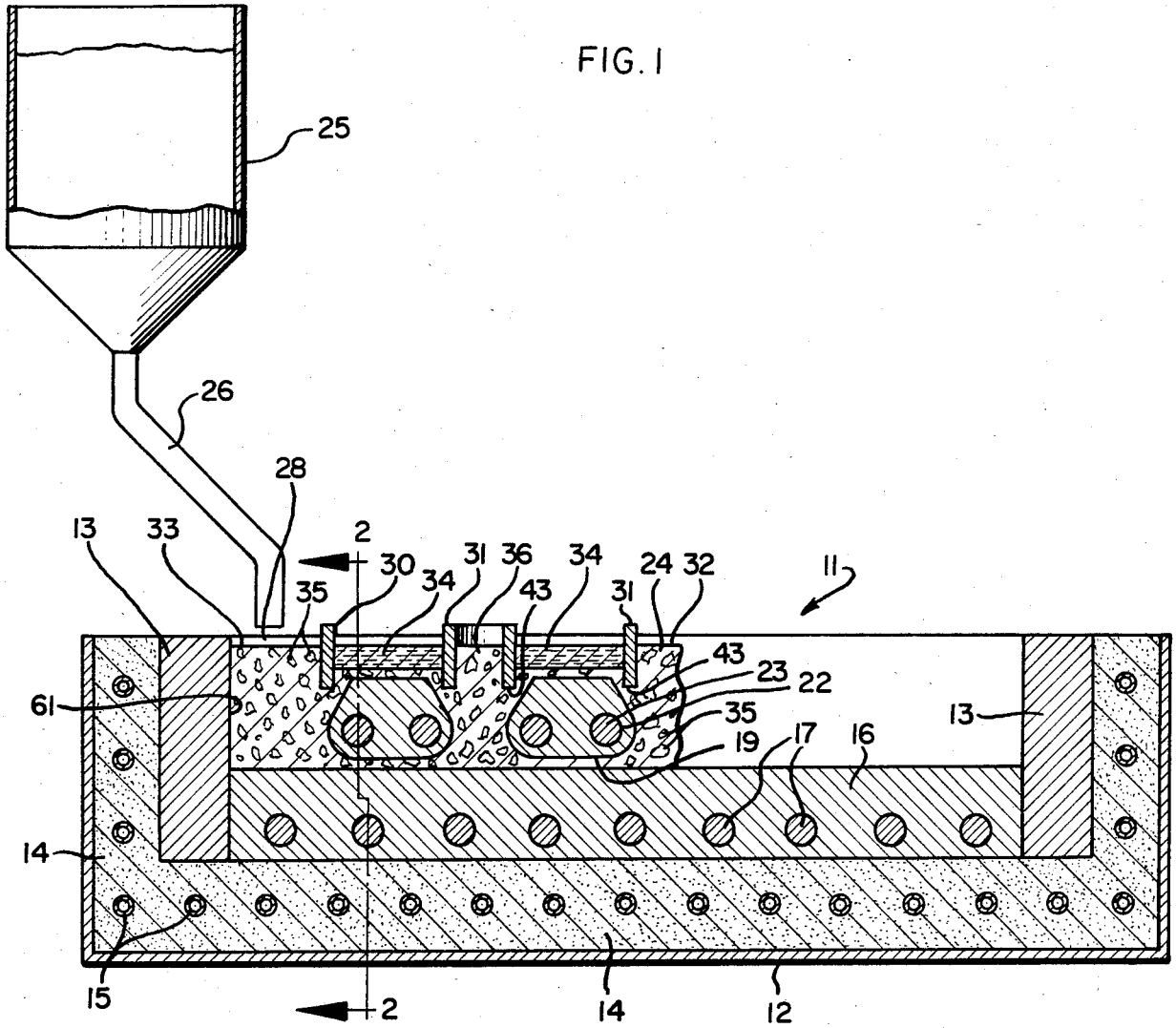
FIG. 1 is a sectional view illustrating an embodiment of an electrolytic reduction cell in accordance with the present invention.
Figure 2:
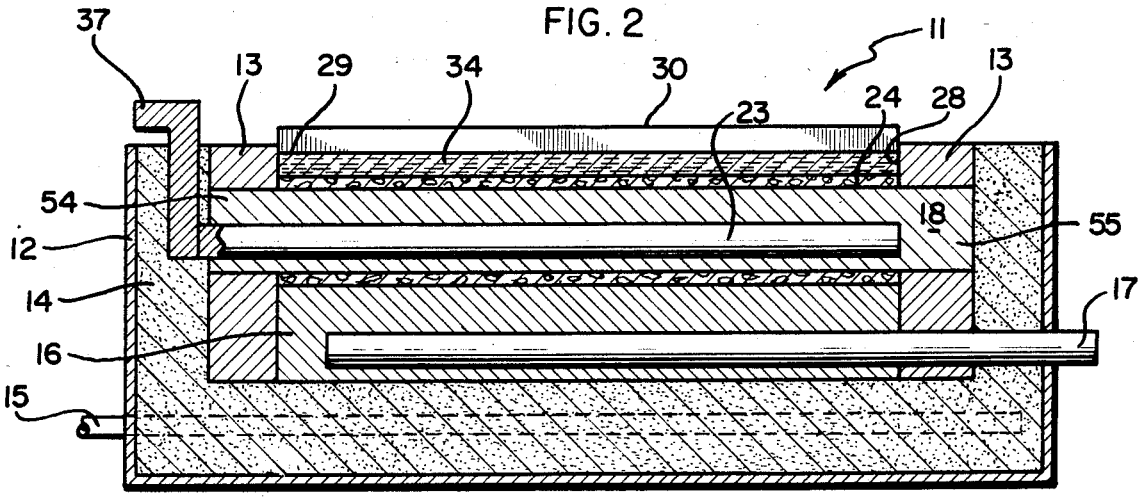
FIG. 2 is a sectional view taken along line 2—2 of FIG. 1.
Figure 3:
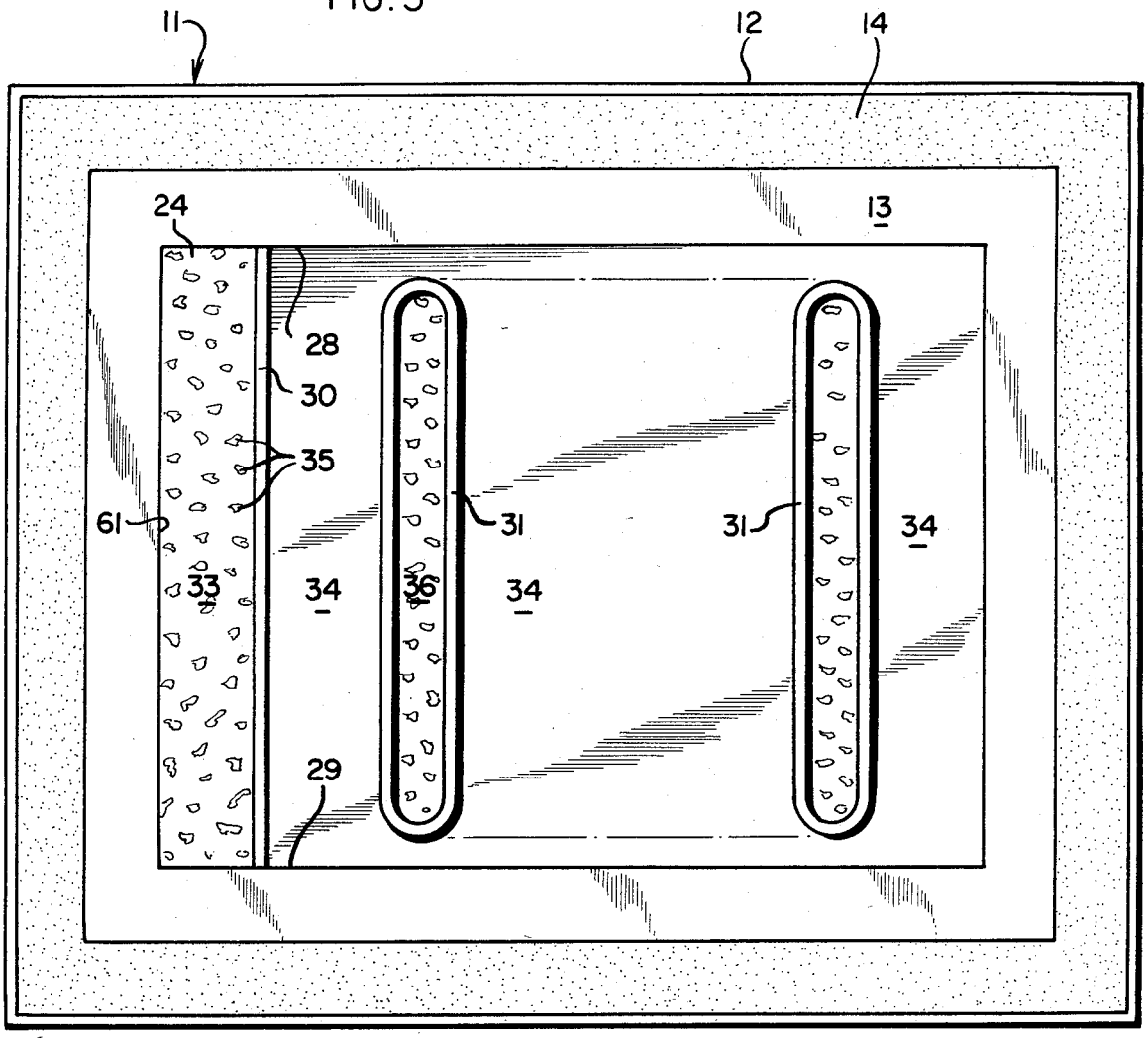
FIG. 3 is a plan view of a portion of the cell.
Figure 4:
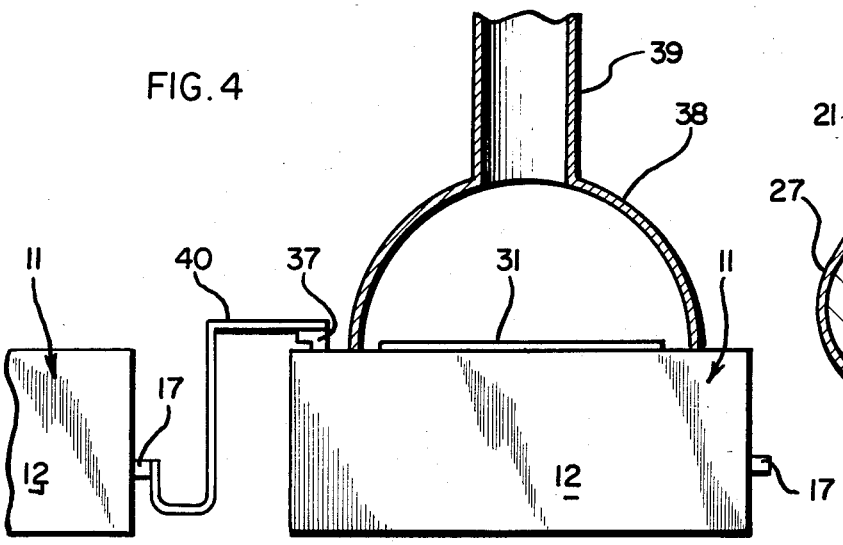
FIG. 4 is a side elevational view, partially in section, of the cell.

Referring initially to FIGS. 1-4, indicated generally at 11 is a cell for the electrolytic reduction of alumina to aluminum, constructed in accordance with an embodiment of the present invention. Cell 11 comprises a steel shell 12 having a bottom and side walls lined with a layer of thermal insulating material 14 within which are cooling pipes 15. The interior of cell 11 has walls lined with refractory material 13 and a bottom constituting an unconsumable anode 16 containing steel conductor bars 17 extending outwardly through steel shell 12 (FIGS. 2 and 4).

The refractory material at 13 is typically silicon carbide brick for higher operating temperatures and magnesium oxide at lower operating temperatures. The thermal insulating material at 14 is typically loose $Al_2O_3$ powder, and the unconsumable anode may be composed of $SnO_2$, oxides of iron and nickel bonded with metallic iron and nickel, other cermets or other materials conventionally utilized for unconsumable anodes.

Contained within cell 11 is a molten electrolyte bath 24 composed of halide salts having a melting point less than that of aluminum and having a density greater than that of aluminum (2.3 g/cm$^3$) and less than that of alumina (4.0 g/cm$^3$). This can be accomplished by mixing barium fluoride or barium chloride or both with the conventional sodium cryolite electrolyte until the desired density is obtained.

Other bath compositions which may be employed include the following:

| Ingredient | Wt. % |
|---|---|
| Bath A | |
| $BaCl_2$ | 60 |
| $AlF_3$ | 20 |
| NaF | 15 |
| NaCl | 5 |
| Bath B | |
| $AlF_3$ | 30 |
| $CaF_2$ | 20 |
| $BaCl_2$ | 45 |
| Other* | 5 |

*$BaF_2$, $MgF_2$, oxides, other impurities.

Figure 5:
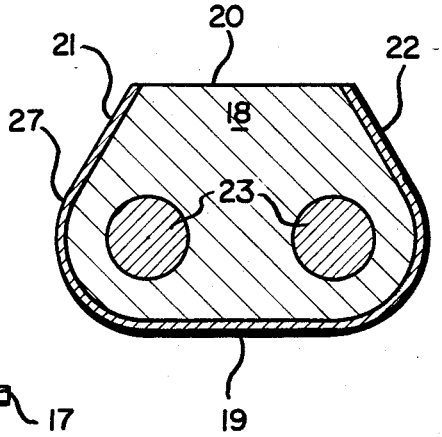
FIG. 5 is a sectional view of a preferred embodiment of cathode for use in accordance with the present invention.

Bath 24 has a top surface 32 below which are a plurality of dimensionally stable cathodes 18 each located wholly below the top surface of the bath. Referring to FIG. 5, each cathode has a cathode bottom 19 spaced above anode 16, and each cathode has sides 21, 22 converging upwardly from cathode bottom 19 toward a cathode top 20. As shown in FIG. 5, the surfaces of cathode sides 21, 22 and of cathode bottom 19 are covered with a layer 27 of titanium diboride. Layer 27 may be in the form of cemented tiles of titanium diboride or in the form of a coating applied as a vapor on the exterior of the cathode, or layer 27 may be applied as a coating in some other manner or it may be present in the form of particles of titanium diboride incorporated into the exterior surface of the cathode during manufacture thereof.

The interior of each cathode 18 is composed of carbon (e.g., graphite). Referring to FIGS. 1, 2 and 5, extending through each cathode 18 are a pair of steel conductor bars 23 each connected to a steel conductor riser 37 extending upwardly from cathode 18 above the top of cell 11. Each riser 37 is connected to a bus 40 which in turn is connected to the anode conductor bar 17 on an adjacent cell 11 (FIG. 4).

Alumina particles may be added in any convenient location and manner, e.g., from a hopper 25 located above cell 11. Communicating with the bottom of hopper 25 is a conduit 26 for delivering alumina particles to a location 33 at the top of electrolyte bath 24, adjacent an interior refractory side wall 13 of the cell. Alumina particles are introduced into the cell through the top surface 32 of bath 24 at location 33 defined in part by a barrier 30 extending between interior end walls 28, 29 of cell 11 adjacent an interior side wall 61 of the cell. Area 33 occupies only a minor part of the horizontal cross-section of the bath.

An electric current is passed through the bath from anode 16 to cathodes 18. The alumina introduced into bath 24 is dissolved therein and formed into ions of aluminum and oxygen ($Al^{3+}$ and $O^{--}$). In the course of a series of reactions, the aluminum ions are converted into metallic aluminum at each cathode 18, and the oxygen ions are converted into gaseous oxygen at anode 16.

The titanium diboride layer 27 covering the bottom and sides of each cathode 18 is wetted by the aluminum which flows along the cathode surfaces covered by the titanium diboride to a location 34 atop bath 24 where the molten aluminum accumulates as a pool.

The gaseous oxygen which forms at the bottom of the cell at anode 16 bubbles upwardly through bath 24 to agitate the bath. This agitation enchances the dissolution of the alumina in the electrolyte bath and maintains substantial near-saturation of alumina in that part of the bath adjacent anode 16, which is desirable. The agitation caused by the upwardly bubbling gaseous oxygen also keeps in suspension the undissolved alumina particles near the anode and substantially inhibits alumina particles 35 within the bath from settling in a layer on the anode, such settling being undesirable. It should be apparent from the foregoing and from the drawings that the method and cell of the present invention, described herein, are devoid of any expedient or provision for maintaining the alumina particles on the anode at the bottom of the bath. It should also be apparent that the method is performed without the employment of a carbon-containing reducing agent.

In a preferred embodiment, it is desirable to prevent the oxygen bubbling upwardly through the bath from mixing with the molten aluminum accumulating atop bath 24. This is accomplished by physically dividing the top of the electrolyte bath with trough-like barrier means 31 into a first zone 34 located directly above each cathode 18 and a second zone 36 located between adjacent cathodes 18, 18. Barrier means 31 are composed of refractory material such as Magnesium oxide or silicon carbide. As noted above, the metallic aluminum is directed into first zone 34 by flowing upwardly along a cathode side 21 or 22 which is directly under first zone 34. The refractory, trough-like barrier means 31 may rest on cathode side surfaces 21 or 22 in which case the bottom edges 43 of the barrier means may be provided with serrations to facilitate the escape of molten aluminum upwardly along cathode side surfaces 21, 22.

Oxygen bubbles are substantially blocked from entering first zone 34 and confined to second zone 36 by barrier means 31 which extends downwardly from the bath's top surface 32, below top surface 32 to a depth greater than the depth of the molten aluminum in first zone 34. The walls of barrier means 31 are located directly above the converging cathode sides 21 or 22, and the walls have a bottom end 43 located below the top 20 of cathode 18 and horizontally and vertically spaced from an adjacent cathode side 21 or 22.

The upwardly bubbling oxygen follows an essentially vertical path to zone 36, while the aluminum directed into zone 34 follows a path having a vertical component and diverging horizontally away from the vertical path followed by the oxygen bubbling upwardly adjacent the cathode 18 at which the aluminum was formed.

The location and spacing of the barrier walls and the slope of the converging cathode walls combine to substantially prevent the oxygen bubbles from mixing with the aluminum in first zone 34 while allowing the oxygen to escape upwardly to second zone 36.

As shown in FIG. 4, located atop cell 11 is an exhaust hood 38 communicating with an exhaust conduit 39 for conducting away from cell 11 the gases generated during operation of the cell.

A cell in accordance with the present invention may operate at a temperature in the range 660°–1,000° C. (1,220°–1,832° F.). 700°–800° C. (1,292°–1,472° F.) is the preferred range. For example, Bath A, the specific composition of which is described above, has a melting point of 680° C. (1,256° F.) and an operating temperature of 730°–740° C. (1,346°–1,364° F.).

At the lower temperatures in the above-described operating range (i.e., below 800° C.), current efficiency is maximized, and there is a minimization of corrosion of the titanium diboride coating the cathode, of corrosion of the anode, of corrosion of the refractory material which lines the interior of the cell and of oxidation of the metallic aluminum accumulating on top of the cell. The temperature is controlled by cooling pipes 15 or by other means to be subsequently described.

As shown in FIG. 2, the opposite ends 54, 55 of a cathode 18 are embedded in refractory wall lining 13, thereby immovably mounting the cathode a fixed distance above anode 16. Because the cathodes are immovable, there is a constant, fixed ACD (e.g., 0.5 in. or 12.7 mm). Because of this and because thermal insulation may change with time, cooling of the cell by an external cooling fluid may be required for temperature control. Hence, the provision of cooling pipes 15 in thermal insulating layer 14.

As an alternative to the employment of external cooling fluid circulated through cooling pipes 15, or in addition thereto, temperature control can be accomplished by employing movable cathodes rather than fixed cathodes to change the ACD and the heat generated in the bath. A movable cathode could also be used to adjust the ACD to compensate for any dimensional changes (i.e., wear) in the electrodes during operation thereof, keeping in mind that the anode is non-consumable and the cathode is dimensionally stable so that reference to dimensional changes in connection with electrodes utilized in accordance with this invention means dimensional changes of a much smaller magnitude over a much longer period of time than occur when the anode is consumable and the cathode is not dimensionally stable.

Embodiments of the present invention utilizing a movable cathode are illustrated in FIGS. 6–8. The principal differences between the cell 41 in these embodiments and cell 11 of FIGS. 1–4 are in the cathode 48 and the structure associated therewith, now to be described. Unlike cathode 18 in FIGS. 1–4, cathode 48 has opposite ends 49, 50 which are spaced from refractory wall lining 13, as a result of which cathode 48 is not immovably fixed relative to anode 16 but is mounted for vertical movement relative to anode 16 to vary the distance between the two electrodes.

Cathode 48 is composed of the same materials as is cathode 18. Contained totally within cathode 48 is a steel conductor bar 53 opposite ends of which are connected to a pair of risers 56, 57 composed of steel and extending upwardly from cathode 48. The upper end of each riser 56, 57 is connected to a cathode support member 58 in turn electrically connected by a cathode flex 59 to a cathode bus connecting member 60. All of the elements 56–60 are electrically connected.

Cathode support member 58 is vertically movable in a conventional manner employing conventional moving means. Cathode flex 59 accommodates vertical movement of cathode support member 58, and all of the elements in the assembly 48, 53 and 56–57 move vertically with cathode support member 58.

Structure is provided to prevent contact between steel risers 56, 57 and the molten aluminum which accumulates in a pool 44 atop electrolyte bath 24 and to prevent oxidation of steel risers 56, 57 by air. More particularly, disposed in close fitting relation around each riser 56, 57, in the embodiment of FIG. 6, is a refractory sleeve 47 having a lower end abutting the top surface of cathode 48.

An alternative to sleeve 47 is illustrated in FIGS. 7–8 wherein a frozen skin of aluminum 46 extends upwardly from the top surface of cathode 48, around each riser 56, 57. Located immediately above frozen aluminum skin 46 is a sleeve 51 having aluminum, heat dissipating fins 45 extending radially outwardly therefrom and from a respective steel riser 56, 57. The aluminum skin is kept frozen by the heat dissipation from fins 45. This arrangement is applicable when the cell is operated at the lower end of the preferred temperature range, around 700° C. The molten aluminum 34 above cathodes 48 is maintained sufficiently deep to cover the cathodes entirely and to prevent oxidation thereof by air but not so deep as to melt back the frozen aluminum skin 46.

In the embodiment of FIGS. 6–8, there is no showing of trough-like barrier means as are shown at 31 in the embodiment of FIGS. 1–4. In the embodiment of FIGS. 6–8, the aluminum pool 44 covers the entire top of the electrolyte bath 24, and in these embodiments, oxygen bubbling upward from anode 16 would pass through the molten aluminum. However, barrier means such as shown at 31 in the embodiment of FIGS. 1–4 can also be provided with the embodiments of FIGS. 6–7, the dimensions and location of the barrier means being adjusted to accommodate the vertical movement of cathode 48. When no barrier means is present, cathode 48 can have a rectangular cross-section, but when barrier means is present, the tapered cross-section shown in FIG. 5 must have a width at bottom 19 sufficiently narrow to clear the bottom end 43 of barrier means 31 during vertical movement of cathode 48.

The foregoing detailed description has been given for clearness of understanding only, and no unnecessary limitations should be understood therefrom, as modifications will be obvious to those skilled in the art.

We claim:

1. A method for reducing alumina to aluminum, employing an electrolytic cell, said method comprising the steps of:

providing said cell with a molten electrolyte bath composed of halide salts having a density greater than that of aluminum and less than that of alumina, said bath having a top surface;

providing a solid, non-consumable anode at the bottom of said bath;

providing a plurality of cathodes each having a cathode bottom spaced above said anode below the top surface of said bath;

introducing into said bath alumina particles devoid of carbonaceous material;

passing an electric current through said bath from said anode to said cathodes;

forming gaseous oxygen at said anode;

bubbling said gaseous oxygen formed at said anode upwardly therefrom, through said bath, to agitate the bath so as to enhance the dissolution of alumina in that part of the bath adjacent the anode to obtain substantial saturation of that part of said bath with dissolved alumina and so as to inhibit substantially alumina particles in the bath from settling on said anode;

forming metallic aluminum at said cathode;

said method being devoid of any expedient for maintaining said particles on the anode at the bottom of the bath;

and accumulating molten aluminum at a location atop said bath;

said method being performed without the employment of a carbon-containing reducing agent in said cell.

2. A method as recited in claim 1 and comprising:

preventing the oxygen bubbling upwardly through said bath from mixing with the molten aluminum accumulating atop said bath.

3. A method as recited in claim 2 and comprising:

physically dividing the top of said electrolyte bath into a first zone located directly above a cathode and a second zone located between adjacent cathodes;

and directing into said first zone the metallic aluminum flowing along a side of the cathode which is directly under said first zone.

4. A method as recited in claim 3 wherein said preventing step comprises:

blocking said oxygen from entering said first zone;

and confining said oxygen to said second zone.

5. A method as recited in claim 3 wherein said directing step comprises:

directing said aluminum along a path having a vertical component and diverging horizontally away from the vertical path followed by the upwardly bubbling oxygen adjacent said cathode.

6. A method as recited in claim 1 wherein said introducing step comprises:

introducing said alumina particles into said cell at a location occupying only a minor part of the horizontal cross-section of the bath.

7. A method as recited in claim 1 wherein:

each of said cathodes is a dimensionally stable cathode located totally below the top surface of the bath and each has cathode sides extending upwardly from said cathode bottom, the surfaces of said cathode sides and bottom being covered with titanium diboride;

and said method comprises flowing said metallic aluminum formed at said cathode along said cathode surfaces covered by the titanium diboride to said location atop said bath.

8. A method as recited in claim 1 and comprising:

maintaining said molten electrolyte bath at a temperature no greater than 800° C. (1,472° F.).

9. A cell for the electrolytic reduction of alumina to aluminum employing alumina particles devoid of carbonaceous material, said cell comprising:

a molten electrolyte bath composed of halide salts having a density greater than that of aluminum and less than that of alumina;

said bath having a top surface;

means for containing said bath;

a non-consumable anode located at the bottom of said bath;

at least one conductor bar for said non-consumable anode, said non-consumable anode being composed of a material separate and distinct from said conductor bar;

a plurality of cathodes each having a cathode bottom spaced above said anode and having cathode sides extending upwardly from the cathode bottom;

means for introducing alumina particles into said cell;

means for passing an electric current through said bath from said anode to said cathode;

said anode comprising means for forming, from said particles, during operation of the cell, gaseous oxygen at said anode and for bubbling said gaseus oxygen, thus formed, upwardly through said bath to agitate the bath so as to enhance the dissolution of alumina in that part of the bath adjacent the anode to obtain substantial saturation of that part of said bath with dissolved alumina and so as to inhibit substantially alumina particles in the bath from settling on said anode;

said cell being devoid of any provision for holding said particles on the anode at the bottom of the bath;

each cathode comprising means for forming metallic aluminum at said cathode during operation of the cell;

and means for accumulating molten aluminum at a location atop said bath.

10. A cell as recited in claim 9 and comprising:

means for preventing the oxygen bubbling upwardly through said bath from mixing with the molten aluminum accumulating atop said bath.

11. A cell as recited in claim 10 wherein:

each cathode is located below the top surface of the bath;

and said means for preventing said oxygen from mixing with said molten aluminum comprises barrier means for physically dividing the top of said electrolyte bath into a first zone located directly above a cathode and a second zone located between adjacent cathodes;

each cathode side comprising means for flowing metallic aluminum along that side and for directing the metallic aluminum flowing along that side into said first zone above that cathode.

12. A cell as recited in claim 11 wherein:

the surfaces of said cathode sides and bottom are covered with titanium diboride.

13. A cell as recited in claim 11 wherein:

said cathode sides converge upwardly from the cathode bottom to a cathode top.

14. A cell as recited in claim 11 wherein:

said barrier means extends downwardly from the top surface of said bath, below said top surface to a depth greater than the depth of the molten aluminum in the first zone.

15. A cell as recited in claim 14 wherein:

said cathode sides converge upwardly from the cathode bottom to a cathode top and said barrier means comprises wall means located directly above a converging cathode side, said wall means having a bottom end located below the top of said cathode and spaced from said cathode side.

16. A cell as recited in claim 9 and comprising:

means immovably mounting each cathode a fixed distance above said anode;

said containing means for the bath comprising side walls having an inner, refractory layer and a layer of thermal insulating material located outwardly of said refractory layer;

and cooling means in said layer of thermal insulating material.

17. A cell as recited in claim 9 and comprising:

means mounting said cathodes for vertical movement relative to said anode to vary the distance therebetween.

18. A cell as recited in claim 17 and comprising:

a top surface on each cathode;

a steel conductor bar in the interior of each cathode;

a vertically disposed, steel conductor bar riser having a lower end physically connected to said steel conductor bar and an upper end located above the top surface of said bath;

and means located around said steel riser for preventing contact between said steel riser and molten aluminum which may accumulate atop said bath and for preventing oxidation of said steel riser by air.

19. A cell as recited in claim 18 wherein said last recited means comprises:

a refractory sleeve in close fitting relation around said steel riser and having a lower end abutting the top surface of said cathode.

20. A cell as recited in claim 18 wherein said last recited means comprises:

a frozen skin of aluminum extending upwardly from the top surface of said cathode;

and aluminum, heat dissipating fins extending radially outwardly from said steel riser at a location immediately above said frozen skin of aluminum.

21. A cell as recited in claim 9 wherein said introducing means comprises:

means for introducing said alumina particles into said cell at a location occupying only a minor part of the horizontal cross-section of the bath.

22. A cell as recited in claim 9 wherein:

each of said cathodes is a dimensionally stable cathode located totally below the top surface of the bath;

and the surfaces of said cathode sides and bottom are covered with titanium diboride.

23. A dimensionally stable cathode for use in a cell for the electrolytic reduction of alumina to aluminum, said cathode comprising:

a top, a bottom and a pair of sides converging from said bottom toward said top;

and titanium diboride covering the surfaces of said bottom and said sides.

24. A cathode as recited in claim 23 and comprising an interior composed of carbon.

25. A cathode as recited in claim 23 and comprising:

a steel conductor bar in the interior of said cathode.

26. A dimensionally stable cathode for use in a cell for the electrolytic reduction of alumina to aluminum, said cathode comprising:

a top surface, a bottom and a pair of sides;

and titanium diboride covering the surfaces of said bottom and said sides;

a steel conductor bar in the interior of said cathode;

a vertically disposed, steel conductor bar riser having a lower end physically connected to said steel conductor bar and an upper end located above the top surface of said cathode;

and means located around said steel riser for preventing dissolution thereof by molten aluminum and for preventing oxidation of said steel riser by air.

27. A cathode as recited in claim 26 wherein said last recited means comprises:

a refractory sleeve in close fitting relation around said steel riser and having a lower end abutting the top surface of said cathode.

28. A cathode as recited in claim 26 wherein said last recited means comprises:

a frozen skin of aluminum extending upwardly from the top surface of said cathode;

and aluminum, heat dissipating fins extending radially outwardly from said steel riser at a location immediately above said frozen skin of aluminum.

29. A cathode as recited in claim 26 and comprising an interior composed of carbon.

* * * * *